US009922485B2

(12) United States Patent
Shibata et al.

(10) Patent No.: US 9,922,485 B2
(45) Date of Patent: Mar. 20, 2018

(54) COIN PROCESSING APPARATUS

(71) Applicant: FUJI ELECTRIC CO., LTD., Kawasaki-shi, Kanagawa (JP)

(72) Inventors: Yoshito Shibata, Tsu (JP); Kazuhiro Tomita, Yokkaiti (JP); Takao Okuhara, Yokkaiti (JP); Takuya Fukuura, Yokkaiti (JP); Katsuya Nakajima, Nagano (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 15/283,852

(22) Filed: Oct. 3, 2016

(65) Prior Publication Data

US 2017/0098338 A1 Apr. 6, 2017

(30) Foreign Application Priority Data

Oct. 6, 2015 (JP) ..... 2015-198822
Oct. 6, 2015 (JP) ..... 2015-198823

(51) Int. Cl.
*G07D 7/00* (2016.01)
*G07D 5/00* (2006.01)
*G07D 1/02* (2006.01)

(52) U.S. Cl.
CPC ..... *G07D 5/00* (2013.01); *G07D 1/02* (2013.01)

(58) Field of Classification Search
CPC .. G07D 1/00; G07D 1/02; G07D 3/00; G07D 5/00; G07D 2201/00; B65G 33/00; B65G 33/02; B65G 33/04; B65G 33/24; B65G 33/26
See application file for complete search history.

(56) References Cited

U.S. PATENT DOCUMENTS

2007/0081832 A1* 4/2007 Yoshida ..... G03G 15/0822 399/254
2011/0281513 A1* 11/2011 Abe ..... G07D 1/00 453/3

FOREIGN PATENT DOCUMENTS

JP 5375425 B2 12/2013

* cited by examiner

*Primary Examiner* — Mark J Beauchaine
(74) *Attorney, Agent, or Firm* — Manabu Kanesaka

(57) ABSTRACT

A coin processing apparatus determines an authenticity and a type of a received coin, holds a coin, which is determined to be an authentic coin, and then sorts and stores the coin for each type of coin and that further pays a stored coin in response to a coin drawing command. The coin processing apparatus includes a conveyor that conveys the coin. The conveyor includes a screw-type conveying member including a cylindrical shaft section, and a blade section provided on an outer circumference of the cylindrical shaft section in a helical fashion and protruding in a radial direction. The screw-type conveying member is rotated around a central axis of the shaft section so that a coin is conveyed.

6 Claims, 11 Drawing Sheets

COIN PROCESSING APPARATUS

CROSS-REFERENCE TO RELATED APPLICATIONS

The present application claims priority to and incorporates by reference the entire contents of Japanese Patent Application No. 2015-198822 filed in Japan on Oct. 6, 2015 and Japanese Patent Application No. 2015-198823 filed in Japan on Oct. 6, 2015.

BACKGROUND

1. Field

The present disclosure relates to a coin processing apparatus and, more particularly, to a coin processing apparatus that determines the authenticity and the type of received coins, holds the coin, which is determined to be an authentic coin, and then sorts and stores it for each type of coin and that further pays the stored coin in response to a coin drawing command.

2. Description of the Related Art

In the related art, with coin processing apparatuses that are used as, for example, a change dispenser, after the authenticity and the type of the coin, dropped through the coin slot, are determined, the coin, which is determined to be an authentic coin, is automatically received, and it is stored in the coin storage that is provided for each type of coin. Furthermore, the coin processing apparatus pays the requested amount of coins, stored in the coin storage, as change to the coin payment port in response to a change payment request from an external device, or the like (see, for example, Japanese Patent No. 5375425).

However, in the above-described coin processing apparatus, coins are conveyed by a belt that extends between rollers in pair in an endless manner, and therefore there occur conveyance failures, such as a reduction in the conveyance force due to a decrease in the friction force, caused by contamination, or the like, of conveyed coins or an occurrence of tilted rotation of a coin that is rotated on the belt and remains at a certain position.

SUMMARY

It is an object of the present disclosure to at least partially solve the problems in the conventional technology.

According to one aspect of the present disclosure, there is provided a coin processing apparatus that determines an authenticity and a type of a received coin, holds a coin, which is determined to be an authentic coin, and then sorts and stores the coin for each type of coin and that further pays a stored coin in response to a coin drawing command, the coin processing apparatus including: a conveyor that conveys the coin, the conveyor including a screw-type conveying member including a cylindrical shaft section, and a blade section provided on an outer circumference of the cylindrical shaft section in a helical fashion and protruding in a radial direction, wherein the screw-type conveying member is rotated around a central axis of the shaft section so that a coin is conveyed.

The above and other objects, features, advantages and technical and industrial significance of this disclosure will be better understood by reading the following detailed description of presently preferred embodiments of the disclosure, when considered in connection with the accompanying drawings.

DETAILED DESCRIPTION

With reference to the attached drawings, a detailed explanation is given below of a preferred embodiment of a coin processing apparatus according to the present disclosure.

Figure 1:
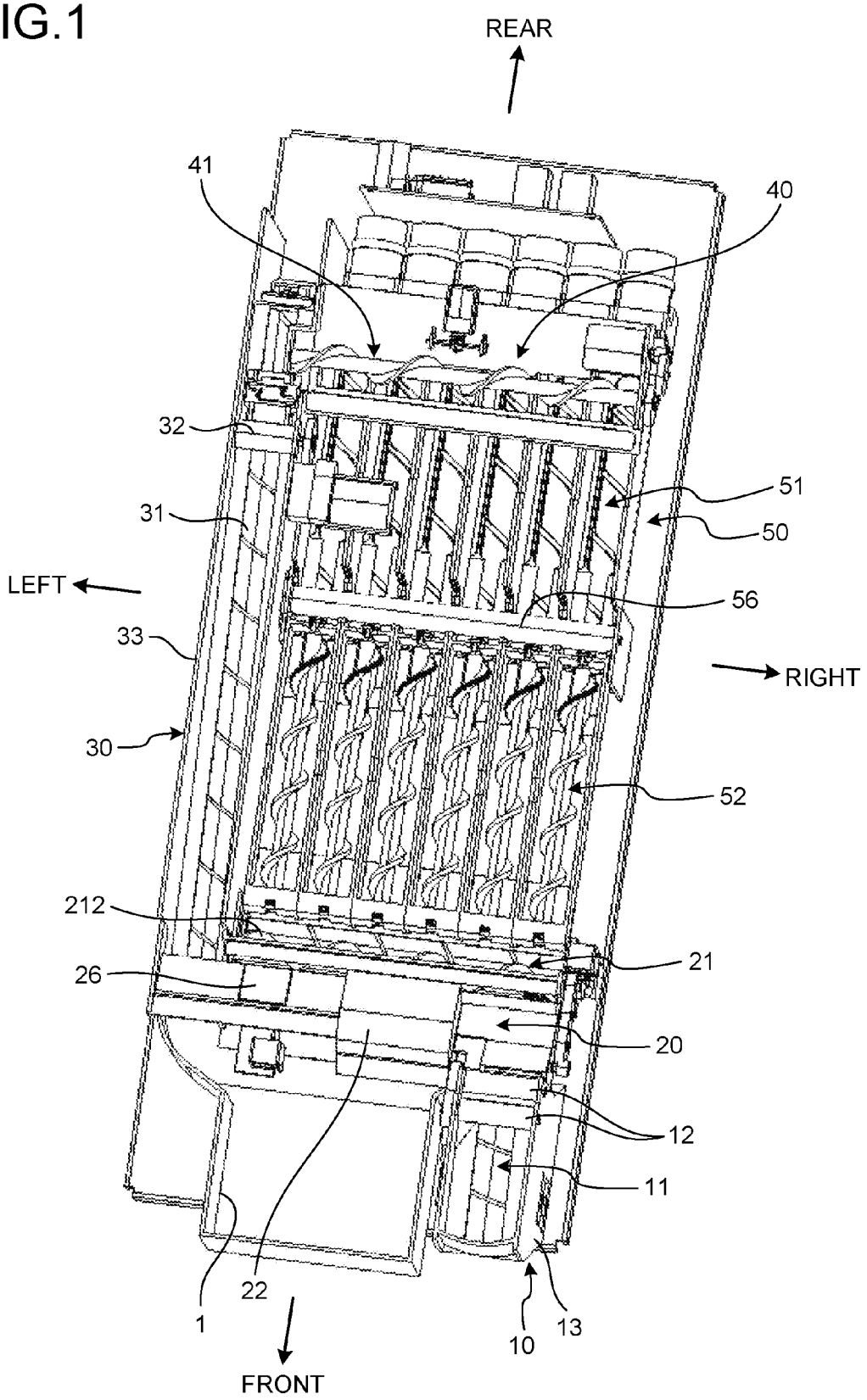
FIG. 1 is a perspective view that illustrates the internal structure of a coin processing apparatus according to an embodiment of the present disclosure.

FIG. 1 is a perspective view that illustrates the internal structure of the coin processing apparatus according to the embodiment of the present disclosure. The coin processing apparatus illustrated here is used as, for example, a change dispenser, and it is configured such that it includes a received-coin conveying section 10, a coin checking section 20, a temporarily holding section 30, a coin sorting section 40, and a coin storage section 50.

Figure 2:
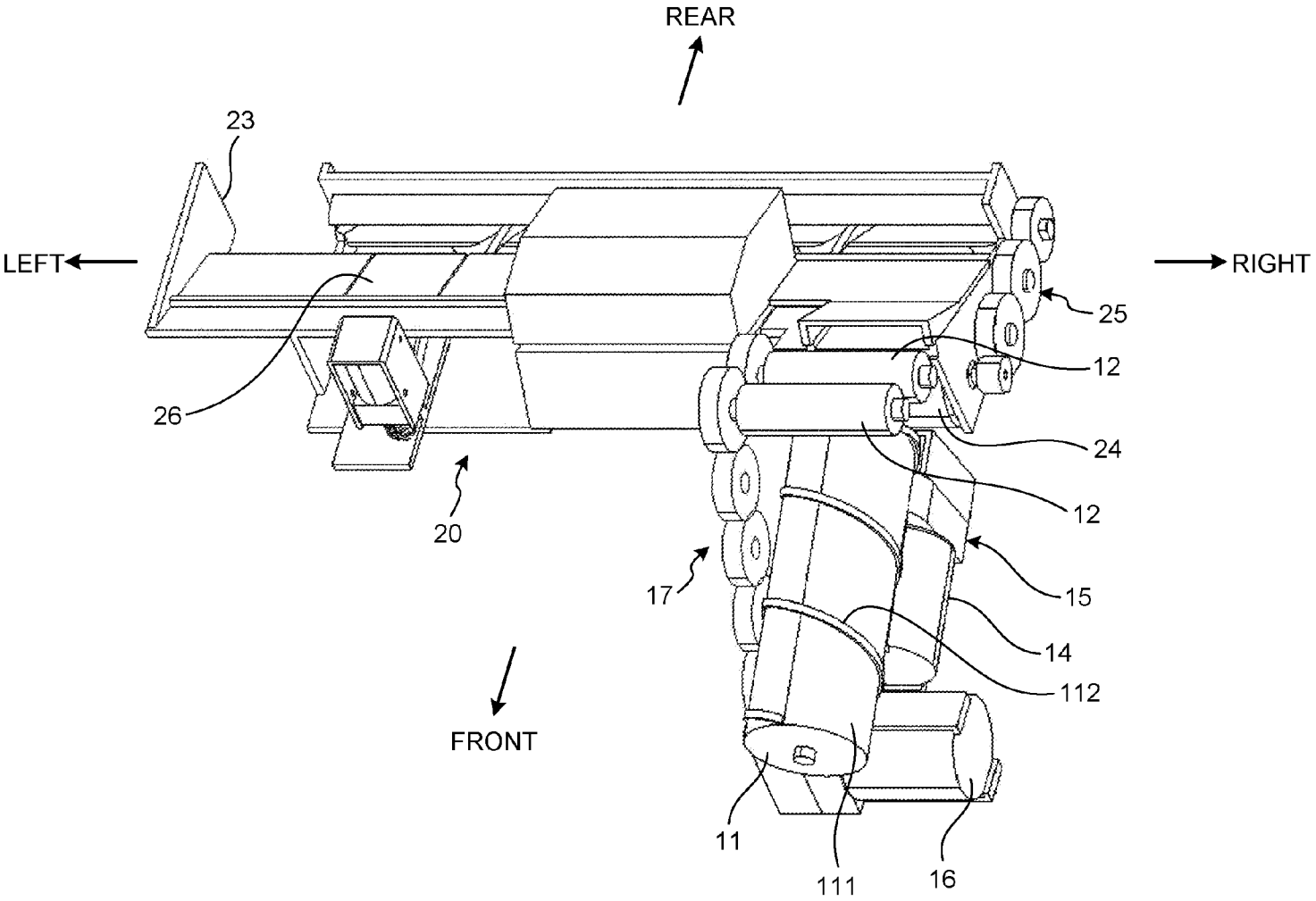
FIG. 2 is a perspective view that illustrates the relevant parts of a received-coin conveying section and a coin checking section, illustrated in FIG. 1, in an enlarged manner.

FIG. 2 is a perspective view that illustrates the relevant parts of the received-coin conveying section 10 and the coin checking section 20, illustrated in FIG. 1, in an enlarged manner. The received-coin conveying section 10 conveys coins that are dropped through an undepicted coin slot. The received-coin conveying section 10 includes a received-coin screw-type conveying member 11 and a received-coin reverse roller 12.

The received-coin screw-type conveying member 11 is configured such that a received-coin blade section 112, protruding in a radial direction, is provided in a helical fashion on the outer circumference of a received-coin shaft section 111, which has a cylindrical shape and extends in a front-back direction. The received-coin screw-type conveying member 11 is provided on a received-coin guide 13 (see FIG. 1) in such a manner that it gradually slopes upward as it is closer to the rear.

The received-coin screw-type conveying member 11 is connected to a motor 14 via a connection member 15, and it is rotated around the central axis of the received-coin shaft section 111 when the motor 14 is driven. Specifically, when the received-coin screw-type conveying member 11 is rotated around the central axis of the received-coin shaft section 111, it conveys coins from the front to the rear in an accumulated manner, and the rear side is the downstream side in a conveying direction.

The multiple (two in the illustrated example) received-coin reverse rollers 12 are provided, and each of them extends in a right-and-left direction perpendicular to the received-coin shaft section 111 on the top of the rear side (the downstream side in the conveying direction) of the received-coin screw-type conveying member 11. The received-coin reverse rollers 12 are connected to a common motor 16 via a connection member 17, and it is rotated around its own axis when the motor 16 is driven.

Each of the above received-coin reverse rollers 12 is rotated around its own axis so that it is brought into contact with coins, conveyed by the received-coin screw-type conveying member 11, whereby the coins are conveyed in such a manner that they are stored one by one in the pitch that is formed by the received-coin blade section 112 of the received-coin screw-type conveying member 11. Here, according to the present embodiment, the pitch formed by the received-coin blade section 112 is the interval between the adjacent received-coin blade sections 112 when the received-coin screw-type conveying member 11 is viewed from the top, and it has such a size that multiple coins with the smallest diameter do not fit into it.

With the received-coin conveying section 10 that has the above-described configuration, it is possible to convey the coins, dropped through the coin slot, to the coin checking section 20 one by one.

The coin checking section 20 determines the authenticity and the type of the coin, conveyed through the received-coin conveying section 10 one by one. The coin checking section 20 includes a coin-checking screw-type conveying member 21 and a determining section 22.

The coin-checking screw-type conveying member 21 is configured such that a coin-checking blade section 212 (see FIG. 1), protruding in a radial direction, is provided in a helical fashion on the outer circumference of a coin-checking shaft section (not illustrated), which has a cylindrical shape and extends in a right-and-left direction. The coin-checking screw-type conveying member 21 is provided on a coin-checking guide 23 in such a manner that it is substantially horizontal.

The coin-checking screw-type conveying member 21 is connected to a motor 24 via a connection member 25, and it is rotated around the central axis of the coin-checking shaft section when the motor 24 is driven. Specifically, when the coin-checking screw-type conveying member 21 is rotated around the central axis of the coin-checking shaft section, it conveys a coin from the right to the left one by one, and the left side is the downstream side in the conveying direction.

The determining section 22 is provided in the middle of the coin-checking screw-type conveying member 21. The determining section 22 determines the authenticity and the type of the coin that is conveyed by the coin-checking screw-type conveying member 21 one by one. If a coin is determined to be "fake" by the determining section 22, it is delivered to a coin outlet port 1 (see FIG. 1) by operating a reject gate 26, provided in the coin-checking guide 23.

With the coin checking section 20 that has the above-described configuration, the authenticity and the type of the coin, conveyed by the received-coin conveying section 10 one by one, are determined so that the coin, which is determined to be "fake", is delivered to the coin outlet port 1 by operating the reject gate 26, while the coin, which is determined to be "authentic", may be conveyed to the temporarily holding section 30.

Figure 3:
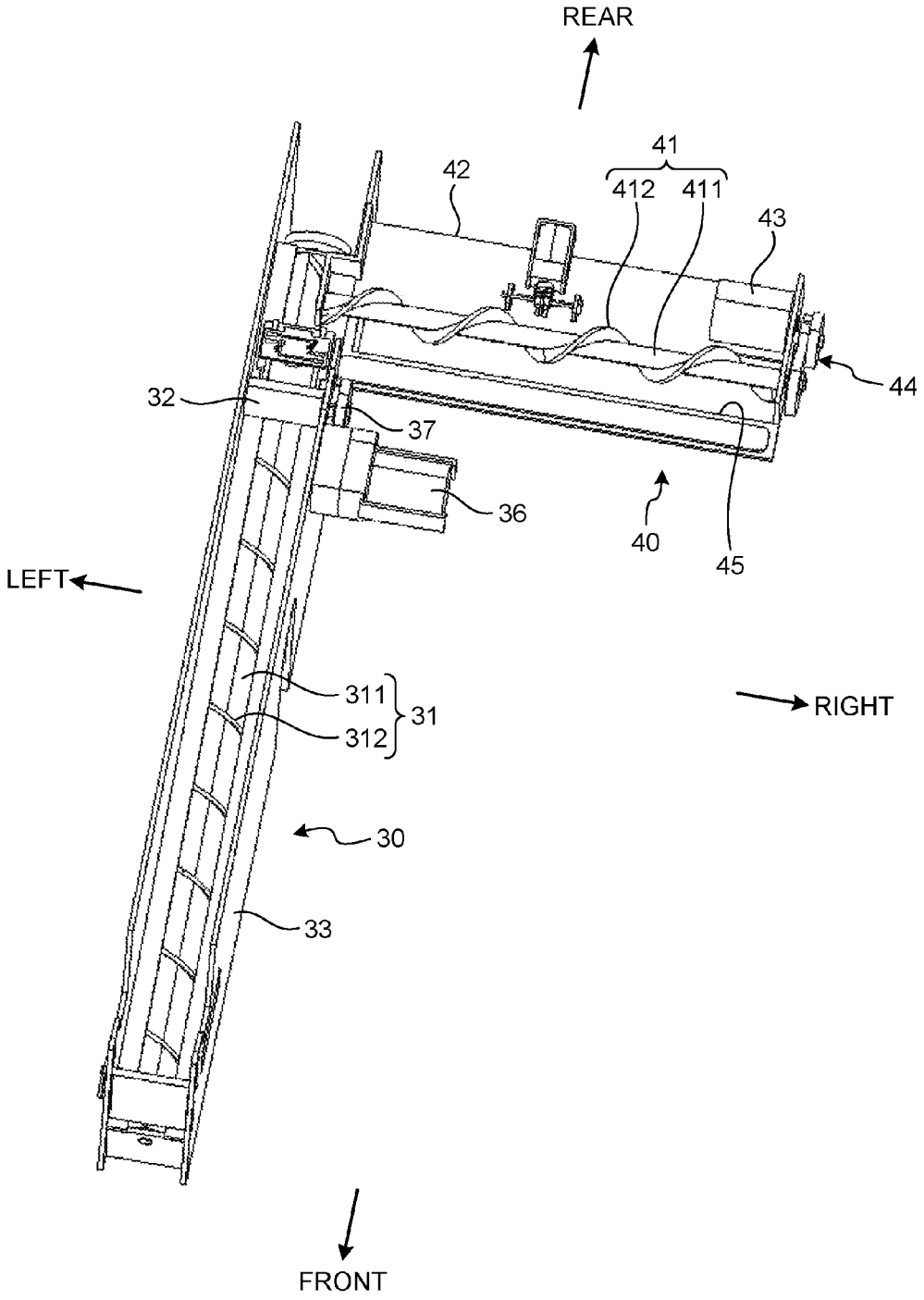
FIG. 3 is a perspective view that illustrates the relevant parts of a temporarily holding section and a coin sorting section, illustrated in FIG. 1, in an enlarged manner.

FIG. 3 is a perspective view that illustrates the relevant parts of the temporarily holding section 30 and the coin sorting section 40, illustrated in FIG. 1, in an enlarged manner. The temporarily holding section 30 temporarily holds the coin that is determined to be "authentic" by the coin checking section 20. The temporarily holding section 30 includes a holding screw-type conveying member 31 and a holding reverse roller 32.

Figure 4:
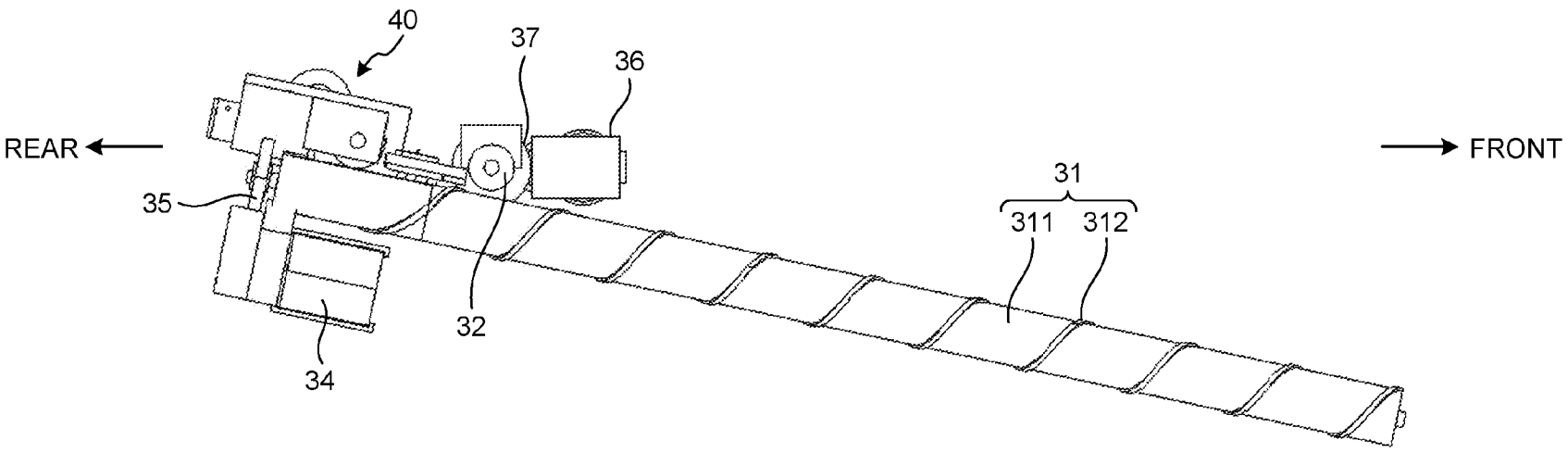
FIG. 4 is an explanatory diagram that schematically illustrates the principal components of the temporarily holding section illustrated in FIG. 3.

The holding screw-type conveying member 31 is configured such that a holding blade section 312, protruding in a radial direction, is provided in a helical fashion on the outer circumference of a holding shaft section 311, which has a cylindrical shape and extends in a front-back direction. As illustrated in FIG. 4, the holding screw-type conveying member 31 is provided in a holding guide 33 in such a manner that it gradually slopes upward as it is closer to the rear.

The holding screw-type conveying member 31 is connected to a motor 34 via a connection member 35, and it is rotated around the central axis of the holding shaft section 311 when the motor 34 is driven. Specifically, when the holding screw-type conveying member 31 is rotated around the central axis of the holding shaft section 311, it conveys coins in an accumulated manner from the front to the rear, and the rear side is the downstream side in the conveying direction.

The holding reverse roller 32 extends in a right-and-left direction perpendicular to the holding shaft section 311 on the top of the rear side (the downstream side in the conveying direction) of the holding screw-type conveying member 31. The holding reverse roller 32 is connected to a motor 36 via a connection member 37, and it is rotated around its own axis when the motor 36 is driven.

The above holding reverse roller 32 is rotated around its own axis so that it is brought into contact with coins, conveyed by the holding screw-type conveying member 31, whereby the coins are conveyed in such a manner that they are stored one by one in the pitch that is formed by the holding blade section 312 of the holding screw-type conveying member 31. Here, according to the present embodiment, the pitch formed by the holding blade section 312 is the interval between the adjacent holding blade sections 312 when the holding screw-type conveying member 31 is viewed from the top, and it has such a size that multiple coins with the smallest diameter do not fit into it.

With the temporarily holding section 30 that has the above-described configuration, the coin, which is determined to be "authentic" by the coin checking section 20, may be held in the upper area of the holding screw-type conveying member 31 if the holding screw-type conveying member 31 is not operated, while the temporarily held coin may be conveyed to the coin sorting section 40 one by one if the holding screw-type conveying member 31 is operated.

The coin sorting section 40 sorts the coins, conveyed one by one through the temporarily holding section 30, for each type of coin. The coin sorting section 40 includes a sorting screw-type conveying member 41.

The sorting screw-type conveying member 41 is configured such that a sorting blade section 412, protruding in a radial direction, is provided in a helical fashion on the outer circumference of a sorting shaft section 411, which has a cylindrical shape and extends in a front-back direction. The sorting screw-type conveying member 41 is provided in a sorting guide 42 in such a manner that it is substantially horizontal.

The sorting screw-type conveying member 41 is connected to a motor 43 via a connection member 44, and it is rotated around the central axis of the sorting shaft section 411 when the motor 43 is driven. Specifically, when the sorting screw-type conveying member 41 is rotated around the central axis of the sorting shaft section 411, it conveys coins one by one from the left to the right in such a manner that it slides on the bottom surface of the sorting guide 42, and the right side is the downstream side in the conveying direction. Here, a sorting hole 45, whose hole area is increased from the left to the right, is formed on the bottom surface of the sorting guide 42.

With the coin sorting section 40 that has the above-described configuration, the coin, conveyed one by one by the temporarily holding section 30, is conveyed from the left to the right and, in the middle of conveyance, it may be sorted to the coin storage section 50 through the sorting hole 45 for each type of coin.

Figure 5:
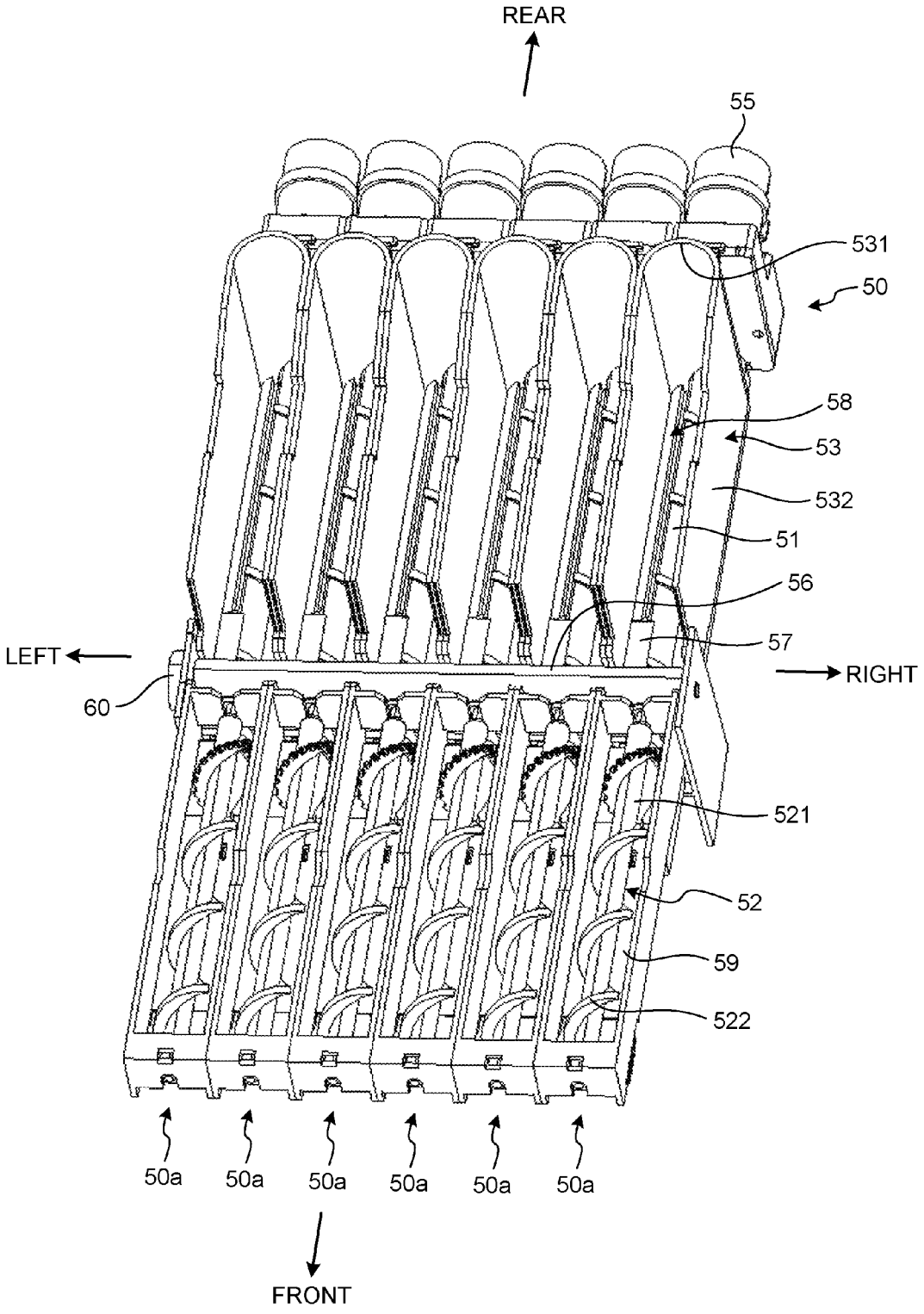
FIG. 5 is a perspective view that illustrates a coin storage section illustrated in FIG. 1.

FIG. 5 is a perspective view that illustrates the coin storage section 50 illustrated in FIG. 1. The coin storage section 50 is configured such that multiple (six in the illustrated example) coin storages 50*a* are arranged side by side in a horizontal direction. Specifically, the coin storage section 50 is configured such that the coin storages 50*a*, storing for example 1-yen coins, 50-yen coins, 5-yen coins, 100-yen coins, 10-yen coins, and 500-yen coins, are arranged side by side in a horizontal direction. The coin storages 50*a*, included in the coin storage section 50, have the same configuration except that their lengths in the right-and-left direction are different. Therefore, hereafter, an explanation is given of the coin storage 50*a* for 500-yen coins, located on the rightmost side, and explanations for the other coin storages 50*a* are omitted.

Figure 6:
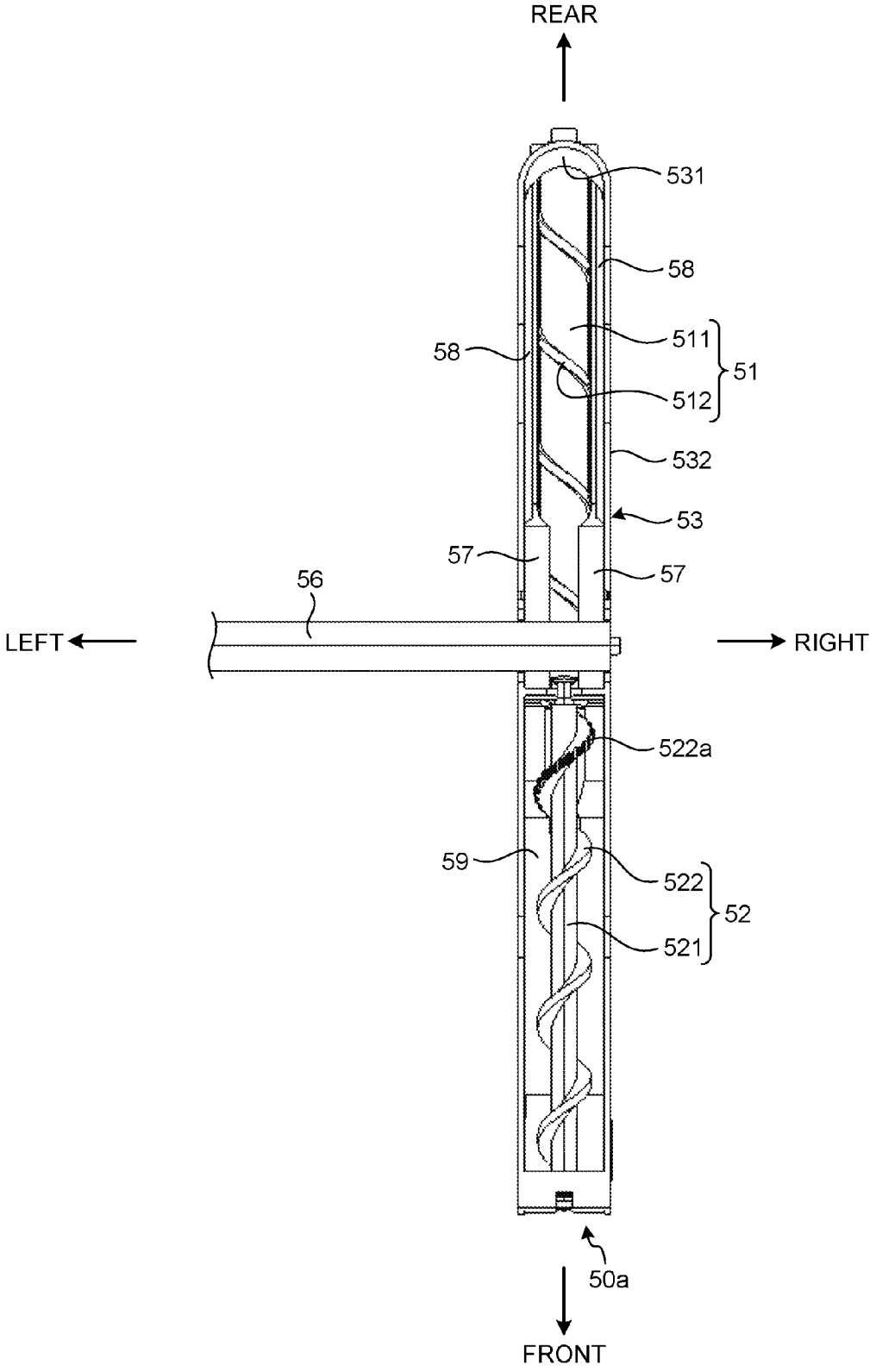
FIG. 6 is a plan view that illustrates the relevant part of the coin storage that is located on the rightmost side, illustrated in FIG. 5.
Figure 7:
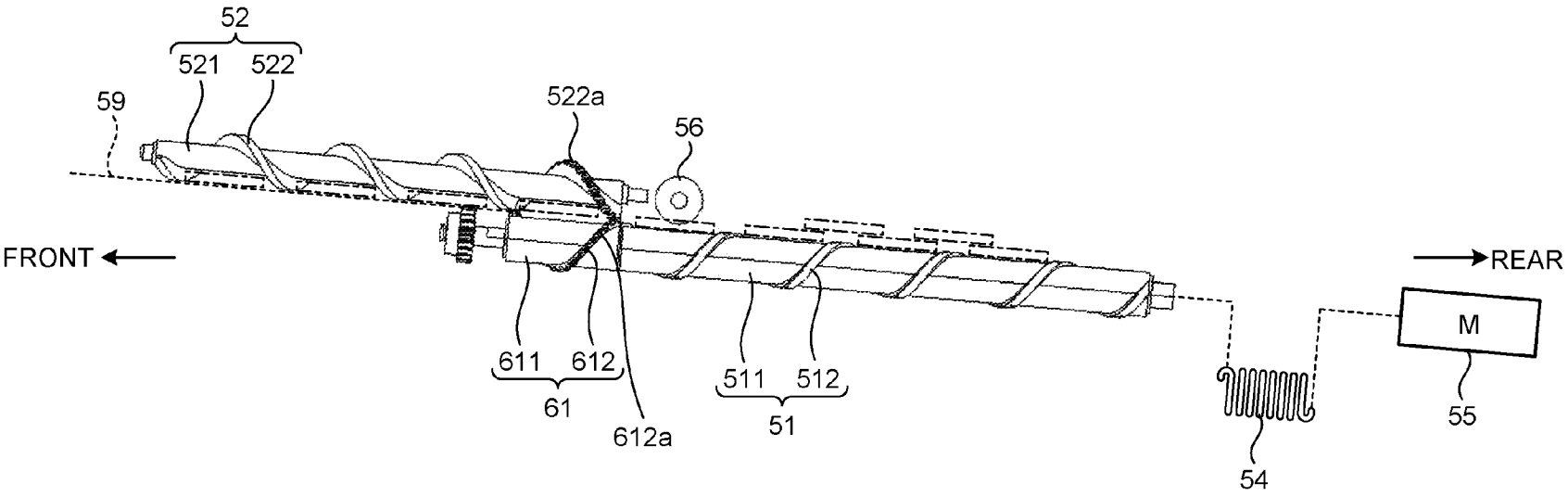
FIG. 7 is an explanatory diagram that schematically illustrates the principal components of the coin storage that is located on the rightmost side, illustrated in FIG. 5.

FIG. 6 is a plan view that illustrates the relevant part of the coin storage 50*a* that is located on the rightmost side, illustrated in FIG. 5, and FIG. 7 is an explanatory diagram that schematically illustrates the principal components of the coin storage 50*a* that is located on the rightmost side, illustrated in FIG. 5. As also illustrated in FIGS. 6 and 7, the coin storage 50*a* includes a first storing screw-type conveying member (a first screw-type conveying member) 51 and a second storing screw-type conveying member (a second screw-type conveying member) 52.

The first storing screw-type conveying member 51 is configured such that a first storing blade section (a first blade section) 512, protruding in a radial direction, is provided in a helical fashion on the outer circumference of a first storing shaft section (a first shaft section) 511, which has a cylindrical shape and extends in a front-back direction.

As illustrated in FIG. 7, the first storing screw-type conveying member 51 is provided in a storage guide 53 in such a manner that it gradually slopes upward as it is closer to the front. The rear edge of the first storing screw-type conveying member 51 is connected to a motor 55 via a storage spring 54 by passing through a cutout 531*a* (see FIG. 9) that is formed on a rear section 531 of the storage guide 53. Here, the storage spring 54 is an elastic body or a bias unit that biases the first storing screw-type conveying member 51 to the front.

The above-described first storing screw-type conveying member 51 is rotated around the central axis of the first storing shaft section 511 when the motor 55 is driven. Specifically, the first storing screw-type conveying member 51 is rotated in one direction (e.g., in a clockwise direction when viewed from the rear side) or in the opposite direction (e.g., in a counterclockwise direction when viewed from the rear side) around the central axis of the first storing shaft section 511.

Furthermore, when the first storing screw-type conveying member 51 is rotated in one direction around the central axis of the first storing shaft section 511, it conveys coins from the rear to the front in an accumulated manner, and the front side is the downstream side in a conveying direction. Conversely, when it is rotated in the opposite direction around the central axis of the first storing shaft section 511, it moves coins from the front to the rear.

Figure 8:
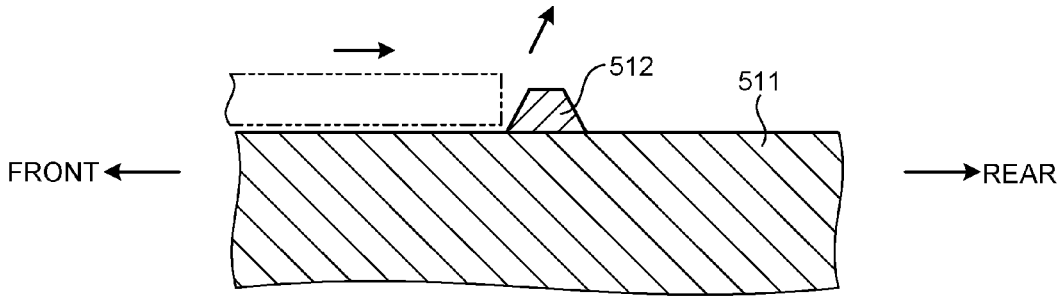
FIG. 8 is an enlarged cross-sectional view that illustrates the relevant part of the first storing screw-type conveying member illustrated in FIGS. 6 and 7.

With the above-described first storing screw-type conveying member 51, as illustrated in FIG. 8, the first storing blade section 512 has a trapezoidal shape as a vertical cross-sectional shape along the central axis of the first storing shaft section 511. Specifically, the first storing blade section 512 is formed in such a manner that the surface (front surface), facing the downstream side in the conveying direction, gradually slopes toward the upstream side (the rear side) in the conveying direction as it is closer to the above, and it is formed in such a manner that the surface (the rear surface), facing the upstream side in the conveying direction, gradually slopes toward the downstream side (the front side) in the conveying direction as it is closer to the above. Moreover, the height of protrusion of the first storing blade section 512 from the outer circumference of the first storing shaft section 511 in the radial direction is less than the thickness of the target coin (e.g., a 500-yen coin).

The above-described storage guide 53 is shaped like a case that extends in a front-back direction and that has an opening on the upper section and on the lower section. As illustrated in FIG. 6, the rear section 531 of the storage guide 53 is curved in such a manner that the front central part has a recess. The storage guide 53 supports a storage reverse roller 56, and it has a first conveying section 57, a second conveying section 58, and a guide section 59 formed therein.

The storage reverse roller 56 extends in a right-and-left direction in such a manner that it crosses each of the coin storages 50*a*, and it is supported by the storage guide 53 by entering recessed portions 532*a* that are formed on both lateral parts 532 in pair on the right and left of the storage guide 53. Here, as the recessed portions 532*a*, formed on the both lateral parts 532 of the storage guide 53, are formed on the upper area of the front edge of the first storing screw-type conveying member 51, the storage reverse roller 56 is supported by extending in the right-and-left direction perpendicular to the first storing shaft section 511 on the top of the front side (the downstream side in the conveying direction) of the first storing screw-type conveying member 51. The storage reverse roller 56 is connected to an undepicted motor via a connection member 60, and it is rotated around its own axis when the motor is driven.

The above-described storage reverse roller 56 is rotated around its own axis so that it is brought into contact with coins, conveyed by the first storing screw-type conveying member 51, whereby the coins are stored one by one in the pitch that is formed by the first storing blade section 512 of the first storing screw-type conveying member 51. Here, according to the present embodiment, the pitch formed by the first storing blade section 512 is the interval between the adjacent first storing blade sections 512 when the first storing screw-type conveying member 51 is viewed from the top, and it has such a size that multiple target coins do not fit into it.

Figure 9:
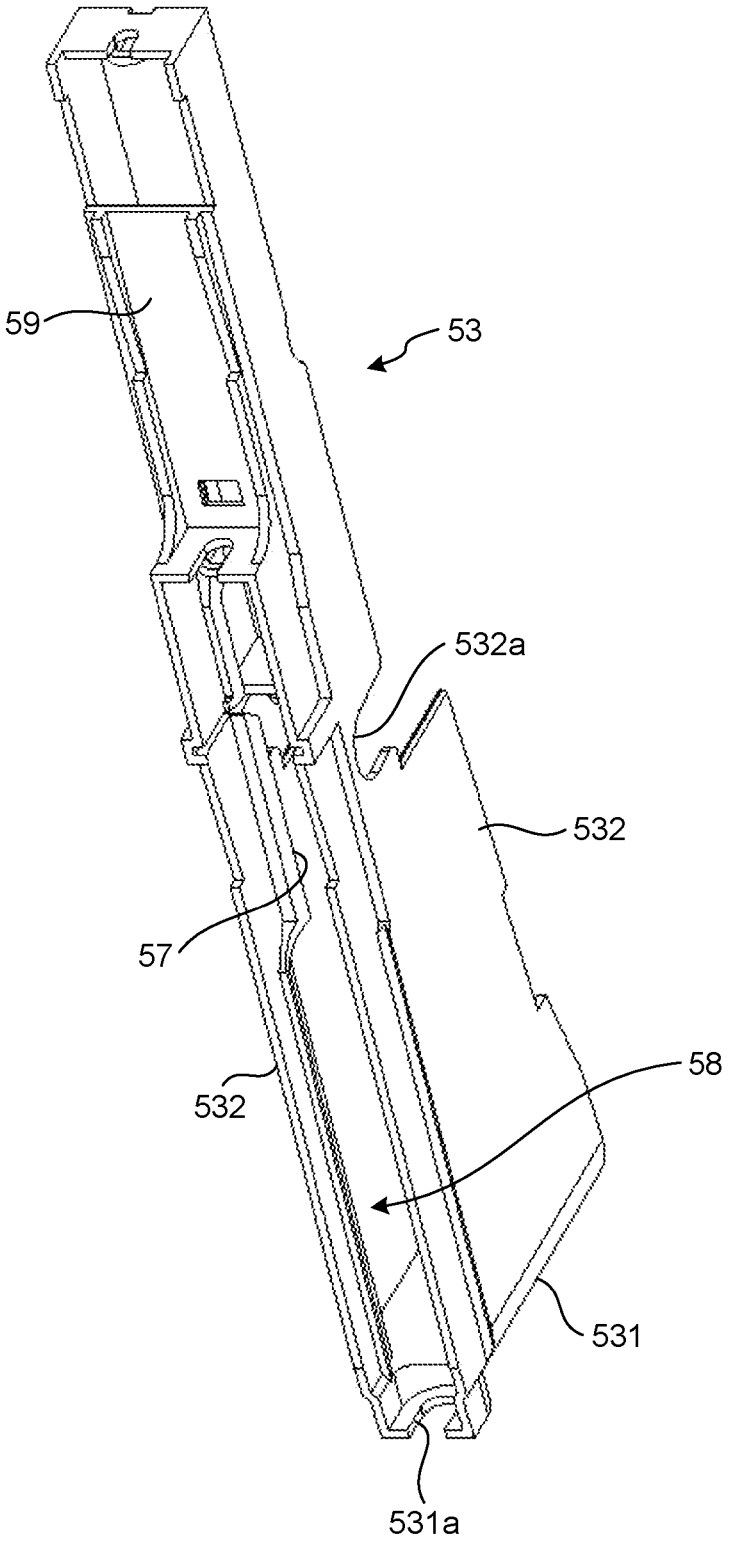
FIG. 9 is a perspective view of a storage guide illustrated in FIG. 6.
Figure 10:
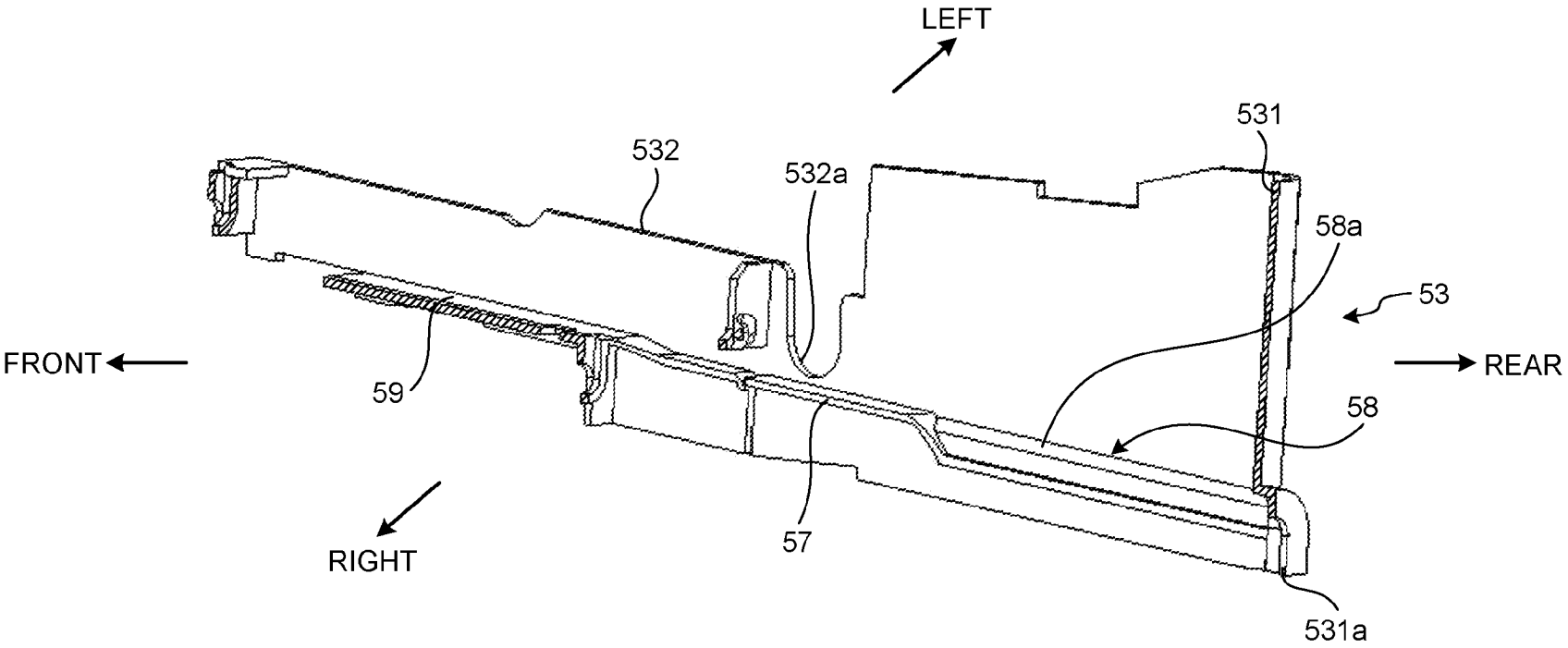
FIG. 10 is a cross-sectional view of the storage guide illustrated in FIG. 9.

As illustrated in FIGS. 6, 9, and 10, the first conveying sections 57 are formed in such a manner that they make a pair on the right and left under the storage reverse roller 56 at the both lateral parts 532 of the storage guide 53. The first conveying sections 57 extend in the extending direction of the first storing shaft section 511, and, more specifically, it extends in such a manner that it gradually slopes upward as it is closer to the front.

Figure 11:
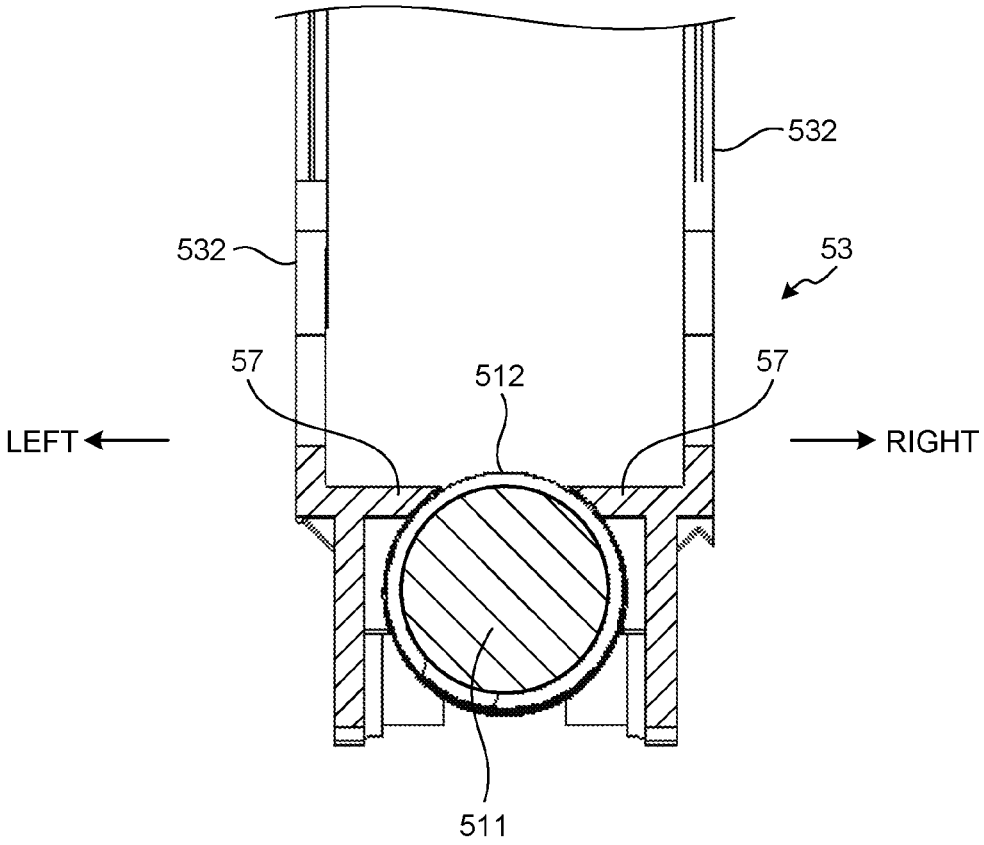
FIG. 11 is an explanatory diagram that illustrates the relation between the first conveying section and the first storing screw-type conveying member, illustrated in FIGS. 9 and 10.

As illustrated in FIG. 11, the above-described first conveying section 57 is provided such that the upper surface thereof is located above the upper section of the first storing shaft section 511 and under the first storing blade section 512.

The second conveying sections 58 are formed in such a manner that they make a pair on the right and left in the area that is posterior to the first conveying section 57 at the both lateral parts 532 of the storage guide 53 and that is opposed to the first storing screw-type conveying member 51. The second conveying sections 58 have a slope surface 58*a* that extends in such a manner that it gradually comes closer to the first storing screw-type conveying member 51 as it is closer to the below.

The guide section 59 is a flat-plate like section that connects the both lateral parts 532 of the storage guide 53 to each other in front of the first conveying section 57. As is the case with the above-described first conveying section 57, the guide section 59 is configured in such a manner that the upper surface thereof gradually slopes upward as it is closer to the front.

The second storing screw-type conveying member 52 is configured such that a second storing blade section (a second blade section) 522, protruding in a radial direction, is provided in a helical fashion on the outer circumference of a second storing shaft section (a second shaft section) 521, which has a cylindrical shape and extends in a front-back direction.

The second storing screw-type conveying member 52 is provided above the guide section 59 in such a manner that it gradually slopes upward as it is closer to the front. In the second storing screw-type conveying member 52, part of a gear 522*a*, formed on the edge surface of the rear edge of the second storing blade section 522, is engaged with an engagement member (engagement unit) 61 that is attached to the front edge of the first storing screw-type conveying member 51. Here, an explanation is first given of the engagement member 61.

The engagement member 61 is attached to the front edge of the first storing shaft section 511, included in the first screw-type conveying member, and it is configured such that an engagement blade section 612, protruding in a radial direction, is provided in a helical fashion on the outer circumference of a cylindrical engagement shaft section 611. A gear 612*a* is formed on the edge surface of the engagement blade section 612, and the rear edge is connected to the front edge of the first storing blade section 512. Part of the gear 612*a* of the engagement blade section 612 of the engagement member 61 is engaged with part of the gear 522*a* of the rear edge of the second storing blade section 522.

When the first storing screw-type conveying member 51 is rotated around the central axis of the first storing shaft section 511 in one direction, the above-described engagement member 61 is integrally rotated with the first storing screw-type conveying member 51 so as to transmit the rotative force to the second storing screw-type conveying member 52, whereby the second storing screw-type conveying member 52 is rotated in the same direction as that of the first storing screw-type conveying member 51.

Conversely, when the first storing screw-type conveying member 51 is rotated in the opposite direction around the central axis of the first storing shaft section 511, the engagement member 61 is not rotated so as to limit transmission of the rotative force to the second storing screw-type conveying member 52. That is, the engagement member 61 functions as a one-way clutch between the first storing screw-type conveying member 51 and the second storing screw-type conveying member 52.

In the coin storage 50*a* that has the above-described configuration, when the above-described first storing screw-type conveying member 51 is rotated in one direction around the central axis of the first storing shaft section 511, it conveys coins from the rear to the front in an accumulated manner.

Then, when the above-described second storing screw-type conveying member 52 is rotated around the central axis of the second storing shaft section 521, the coins, conveyed via the first storing screw-type conveying member 51 and the engagement member 61, are stored one by one in the pitch, formed by the second storing blade section 522 of the second storing screw-type conveying member 52, on the upper surface of the guide section 59. Here, according to the present embodiment, the pitch formed by the second storing blade section 522 is the interval between the adjacent second storing blade sections 522 when the second storing screw-type conveying member 52 is viewed from beneath, and it has such a size that multiple target coins do not fit into it.

Then, in the above-described coin storage 50*a*, while the coin is stored in the foremost pitch, formed by the second storing blade section 522, the second screw-type conveying member is rotated 360 degrees in one direction around the central axis of the second storing shaft section 521 so that the coin, stored in the foremost pitch, is delivered to the front one by one, whereby it may be sent to the coin outlet port 1.

With the coin processing apparatus that has the above-described configuration, in the received-coin conveying section 10, the coin checking section 20, the temporarily holding section 30, the coin sorting section 40, and the coin storage section 50, a conveyor that conveys coins is constituted of the screw-type conveying member 11, or the like, on which the blade section 112, or the like, protruding in a radial direction, is provided in a helical fashion on the outer circumference of the cylindrical shaft section 111, or the like. Furthermore, the coins may be conveyed when the screw-type conveying member 11, or the like, is rotated around the central axis of the shaft section 111, or the like, whereby it is possible to prevent the occurrence of conveyance failures, such as a reduction in the conveyance force due to contamination, or the like, caused by conveyed coins, or an occurrence of tilted rotation. Therefore, coins may be conveyed in a desirable manner while a reduction in the conveyance force, an occurrence of tilted rotation, or the like, is prevented.

In the above-described coin processing apparatus, the first storing screw-type conveying member 51 is rotated in the opposite direction around the central axis of the first storing shaft section 511 so that accumulated coins may be moved to the rear; therefore, the pile formed due to accumulation of coins may be broken by bringing a part of accumulated coins into contact with the front surface of the rear section 531 of the storage guide 53. Furthermore, as described above, as the front central part of the rear section 531 of the storage guide 53 is curved in such a manner that it has a recess, it may be ensured that the coin, abutting the rear section 531, is in a laid-over position on its side, and it is possible to prevent coins from being brought into contact with the rear section 531 and being held in a standing position. Therefore, coins may be conveyed in a desirable manner.

In the above-described coin processing apparatus, the second conveying section 58 of the storage guide 53 has the slope surface 58*a* that extends in such a manner that it gradually comes closer to the first storing screw-type conveying member 51 as it is closer to the below; therefore, coins may be prevented from being held in a standing position in the gap between the first storing screw-type conveying member 51 and the both lateral parts 532 of the storage guide 53. Thus, the coins may be conveyed in a desirable manner.

In the above-described coin processing apparatus, the first conveying section 57 of the storage guide 53 is provided under the storage reverse roller 56 such that it extends in the extending direction of the first storing shaft section 511, whereby the passing performance of coins may be improved and thus coins may be conveyed in a desirable manner. Furthermore, the first conveying section 57 is provided such that the upper surface thereof is located above the upper section of the first storing shaft section 511 and under the first storing blade section 512; thus, the passing performance of coins may be improved, and coins may be conveyed in a desirable manner.

In the above-described coin processing apparatus, the height of protrusion of the first storing blade section 512 of the first storing screw-type conveying member 51 from the outer circumference of the first storing shaft section 511 in the radial direction is less than the thickness of the target coin (e.g., a 500-yen coin); therefore, coins may be prevented from being stuck in the pitch formed by the first storing blade section 512, and thus coins may be conveyed in a desirable manner.

In the above-described coin processing apparatus, the first storing blade section 512 of the first storing screw-type conveying member 51 has a trapezoidal shape as a vertical cross-sectional shape along the central axis of the first storing shaft section 511; therefore, if it is pushed by a coin in the direction opposite to the conveying direction, the coin may be moved obliquely upward to the side opposite to the conveying direction, whereby it is possible to prevent the occurrence of lock due to a coin jam.

In the above-described coin processing apparatus, the rear edge of the first storing screw-type conveying member 51 is connected to the motor 55 via the storage spring 54, which applies a bias to the front; therefore, if the force toward the side opposite to the conveying direction is increased due to a coin jam, or the like, while coins are conveyed, the first storing screw-type conveying member 51 may be displaced to the rear against the biasing force of the storage spring 54. Thus, it is possible to prevent the occurrence of lock due to a coin jam.

In the above-described coin processing apparatus, as coins are stored one by one in the pitch formed by the second storing blade section 522 of the second storing screw-type conveying member 52, coins are prepared to be drawn in a separated state. Thus, if a coin drawing command is given, the second storing screw-type conveying member 52 is rotated by only a predetermined number of times in one direction so that a predetermined number of coins may be paid out. That is, instead of separating and paying the stored coin in accordance with a coin drawing command in a conventional manner, only paying may be conducted; thus, the time for drawing coins may be shortened.

In the above-described coin processing apparatus, the second storing screw-type conveying member 52 is rotated 360 degrees in one direction around the central axis of the second storing shaft section 521 so that the coin, stored in the foremost pitch, is delivered to the front one by one; therefore, if the number of rotations of the second storing screw-type conveying member 52 in one direction is controlled, the number of coins paid by the second storing screw-type conveying member 52 may be controlled.

In the above-described coin processing apparatus, when the first storing screw-type conveying member 51 is rotated in one direction around the central axis of the first storing shaft section 511, the engagement member 61 transmits the rotative force to the second storing screw-type conveying member 52 so that the second storing screw-type conveying member 52 is rotated in the same direction as that of the first storing screw-type conveying member 51 and, if the first storing screw-type conveying member 51 is rotated in the opposite direction around the central axis of the first storing shaft section 511, limits the transmission of the rotative force to the second storing screw-type conveying member 52, whereby it is possible to prevent the coins, stored in the second storing screw-type conveying member 52 one by one, from being conveyed to the rear.

Although the preferred embodiment of the present disclosure is explained above, the present disclosure is not limited thereto, and various changes may be made.

According to the above-described embodiment, the front central part of the rear section 531 of the storage guide 53 is curved in such a manner that it has a recess; however, according to the present disclosure, it does not always need to be curved and, if coins may be prevented from being held in a standing position, it may be formed in such a manner that it gradually slopes forward as it is closer to the right, for example.

According to the above-described embodiment, the height of protrusion of the first storing blade section 512 of the first storing screw-type conveying member 51 from the outer circumference of the first storing shaft section 511 in the radial direction is less than the thickness of the target coin; however, according to the present disclosure, the height of protrusion of each blade section (the received-coin blade section 112, the coin-checking blade section 212, the holding blade section 312, and the sorting blade section 412) of not only the first storing screw-type conveying member 51 but also each screw-type conveying member (the received-coin screw-type conveying member 11, the coin-checking screw-type conveying member 21, the holding screw-type conveying member 31, and the sorting screw-type conveying member 41) in the received-coin conveying section 10, the coin checking section 20, the temporarily holding section 30, and the coin sorting section 40 from the outer circumference of each shaft section (the received-coin shaft section 111, the coin-checking shaft section, the holding shaft section 311, and the sorting shaft section 411) in the radial direction may be less than the thickness of coins with the minimum thickness among passed coins. Furthermore, according to the present disclosure, the height of protrusion of the second storing blade section 522 of the second storing screw-type conveying member 52 from the outer circumference of the second storing shaft section 521 in the radial direction may be less than the thickness of the target coin.

According to the above-described embodiment, the first conveying section 57 and the second conveying section 58 are provided in the storage guide 53, included in the coin storage 50*a* (the coin storage section 50); however, according to the present disclosure, a first conveying section, or the like, may be provided in the received-coin guide 13 or the holding guide 33 of the received-coin conveying section 10 or the temporarily holding section 30, which has a reverse roller as a component.

According to the above-described embodiment, the first storing blade section 512 of the first storing screw-type conveying member 51 has a trapezoidal shape as a vertical cross-sectional shape along the central axis of the first storing shaft section 511; however, according to the present disclosure, the first storing blade section 512 may not have a trapezoidal shape if it is formed in such a manner that the surface facing the downstream side in the conveying direction gradually slopes toward the upstream side in the conveying direction as it is closer to the above. Furthermore, according to the present disclosure, it is preferable that not only the first storing blade section 512 but also the other blade sections, such as 112, are formed in such a manner that the surface facing the downstream side in the conveying direction gradually slopes toward the upstream side in the conveying direction as it is closer to the above.

According to the above-described embodiment, the coins are stored one by one in the pitch formed by the second storing blade section 522 of the second storing screw-type conveying member 52, i.e., in the interval between the adjacent second storing blade sections 522 when the second storing screw-type conveying member 52 is viewed from beneath; however, according to the present disclosure, the coins may be stored one by one in the interval between the adjacent second storing blade sections 522 when the second storing screw-type conveying member 52 is viewed from the left and the right. Thus, the coins may be paid out by only rotating the second storing screw-type conveying member 52 180 degrees in one direction.

Although not described in the above-described embodiment, according to the present disclosure, the first storing blade section 512 may be configured such that it has a convex in the center of the part on the upstream side (the rear side) in the conveying direction. Thus, it is possible to prevent the occurrence of tilted rotation in the neighborhood of the rear section 531 of the storage guide 53.

Furthermore, according to the present disclosure, the received-coin guide 13 or the holding guide 33 may be provided with a protruding object that has a tilt on the upstream side in the conveying direction of each reverse roller. Thus, if two coins are stored and conveyed in the pitch formed by the blade section 112, or the like, the protruding object may be brought into contact with one of the coins to flip it, whereby the occurrence of lock may be prevented, and coins may be conveyed in a desirable manner.

According to the present disclosure, each blade section, such as 112, may be intermittently provided in each screw-type conveying member, such as 11.

According to the present disclosure, a conveyor is provided with a screw-type conveying member, on which a blade section, protruding in a radial direction, is provided on the outer circumference of a cylindrical shaft section in a helical fashion, and the screw-type conveying member is rotated around the central axis of the shaft section so that coins are conveyed, whereby the occurrence of conveyance failures, such as a reduction in the conveyance force due to contamination, or the like, caused by conveyed coins, or an occurrence of tilted rotation, may be prevented. Therefore, there is an advantage such that a reduction in the conveyance force, an occurrence of tilted rotation, or the like, is prevented so that coins may be conveyed in a desirable manner.

Furthermore, according to the present disclosure, the blade section is formed in such a manner that the surface facing the downstream side in the conveying direction gradually slopes toward the upstream side in the conveying direction as it is closer to the above; therefore, if it is pushed by a coin in the direction opposite to the conveying direction, the coin may be moved obliquely upward to the side opposite to the conveying direction, whereby there is an advantage such that it is possible to prevent the occurrence of lock due to a coin jam.

Although the disclosure has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A coin processing apparatus that determines an authenticity and a type of a received coin, holds a coin, which is determined to be an authentic coin, and then sorts and stores the coin for each type of coin and that further pays a stored coin in response to a coin drawing command, the coin processing apparatus comprising:

a conveyor that conveys the coin, the conveyor including
- a screw-type conveying member including
- a cylindrical shaft section, and
- a blade section provided on an outer circumference of the cylindrical shaft section in a helical fashion and protruding in a radial direction, wherein the screw-type conveying member is rotated around a central axis of the shaft section so that the coin is conveyed, and the blade section is formed in such a manner that a surface facing a downstream side in a conveying direction gradually slopes toward an upstream side in the conveying direction as the surface is apart from the shaft section in the radial direction, and the blade section spirally extends around the outer circumference of the cylindrical shaft section to form intervals in the conveying direction, and has a height in the radial direction less than thickness of the coin to prevent the coin from being stuck in the intervals.

2. The coin processing apparatus according to claim 1, wherein the blade section has a trapezoidal shape as a vertical cross-sectional shape in a direction of the central axis of the shaft section.

3. The coin processing apparatus according to claim 1, wherein the blade section further includes another surface facing the upstream side in the conveying direction and sloping in a direction apart from the shaft section toward the downstream side in the conveying direction, and a top surface connecting upper ends of the surface and the another surface.

4. A coin processing apparatus that determines an authenticity and a type of a received coin, holds a coin, which is determined to be an authentic coin, and then sorts and stores the coin for each type of coin and that further pays a stored coin in response to a coin drawing command, the coin processing apparatus comprising:

a conveyor that conveys the coin, the conveyor including
- a screw-type conveying member including
- a cylindrical shaft section, and
- a blade section provided on an outer circumference of the cylindrical shaft section in a helical fashion and protruding in a radial direction; and a bias unit that biases one end of the shaft section connected to a driving source in a conveying direction of the coin, wherein the screw-type conveying member is rotated around a central axis of the shaft section so that the coin is conveyed.

5. A coin processing apparatus that determines an authenticity and a type of a received coin, holds a coin, which is determined to be an authentic coin, and then sorts and stores the coin for each type of coin and that further pays a stored coin in response to a coin drawing command, the coin processing apparatus comprising:

a conveyor that conveys the coin, the conveyor including a screw-type conveying member including a cylindrical shaft section, and a blade section provided on an outer circumference of the cylindrical shaft section in a helical fashion and protruding in a radial direction; and a reverse roller that is provided in a rotatable manner around a central axis of the reverse roller in such a manner that the reverse roller extends in a direction perpendicular to the shaft section on top of the screw-type conveying member on a downstream side in a conveying direction, the reverse roller being brought into contact with the coin conveyed by the screw-type conveying member such that the reverse roller conveys the coin in a manner that the coin is stored one by one in a pitch formed by the blade section of the screw-type conveying member, wherein the screw-type conveying member is rotated around a central axis of the shaft section so that the coin is conveyed.

6. The coin processing apparatus according to claim 5, wherein the screw-type conveying member is provided in such a manner that the screw-type conveying member gradually slopes upward as the screw-type conveying member is closer to an installation position of the reverse roller.

* * * * *